United States Patent [19]

Steffl et al.

[11] Patent Number: 5,026,080

[45] Date of Patent: Jun. 25, 1991

[54] CASTERING WHEELS FOR ROLLER SKATES

[76] Inventors: John C. Steffl, 3555 Oxford Ave. 7F, Bronx, N.Y. 10463; George Spector, 233 Broadway, New York, N.Y. 10007

[21] Appl. No.: 502,417

[22] Filed: Mar. 30, 1990

[51] Int. Cl.[5] ..... A63C 17/02

[52] U.S. Cl. ..... 280/87.042; 16/35 R; 280/87.041; 280/89

[58] Field of Search ..... 280/87.01, 87.041, 87.042, 280/87.021, 872, 89; 16/35 R, 35 D; 188/1.12; 192/138

[56] References Cited

U.S. PATENT DOCUMENTS 3,310,319 3/1967 Collins ..... 280/87.042
4,073,500 2/1978 Campeau ..... 280/87.041
4,805,936 2/1989 Krantz ..... 280/842

FOREIGN PATENT DOCUMENTS 109905 6/1925 Switzerland ..... 280/87.041

*Primary Examiner*—Andres Kashnikow
*Assistant Examiner*—Eric Culbreth

[57] ABSTRACT

An improved skateboard is provided and consists of a deck having a tail and a nose. A pair of rear wheels fixed against swivelling are attached to underside of the deck at the tail which do not swivel. A pair of front casters are attached to underside of the deck at the nose which swivel together at forty five degrees in either direction for increased maneuverability of the skateboard. In a second embodiment the pair of front casters are replaced with one caster which can swivel three hundred and sixty degree in either direction.

2 Claims, 1 Drawing Sheet

CASTERING WHEELS FOR ROLLER SKATES

BACKGROUND OF THE INVENTION

The instant invention relates generally to skating devices and more specifically it relates to an improved skateboard which provides casters thereon for increased maneuverability of the skateboard.

There are available various conventional skating devices which do not provide the novel improvements of the invention herein disclosed.

SUMMARY OF THE INVENTION

A primary object of the present invention is to provide an improved skateboard that will overcome the shortcomings of the prior art devices.

Another object is to provide an improved skateboard that includes two front casters instead of the standard wheel assembly in which the two front casters can swivel together at forty five degrees in either direction for increased maneuverability for the skateboard.

An additional object is to provide an improved skateboard that includes one front caster instead of the standard wheel assembly in which the one front caster can swivel three hundred and sixty degrees in either direction for increased maneuverability of the skateboard.

A further object is to provide an improved skateboard that is simple and easy to use.

A still further object is to provide an improved skateboard that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
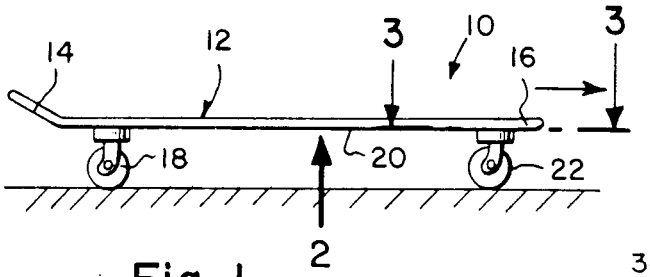
FIG. 1 is a side view of a first embodiment of the invention being a skateboard with four casters thereon.
Figure 2:
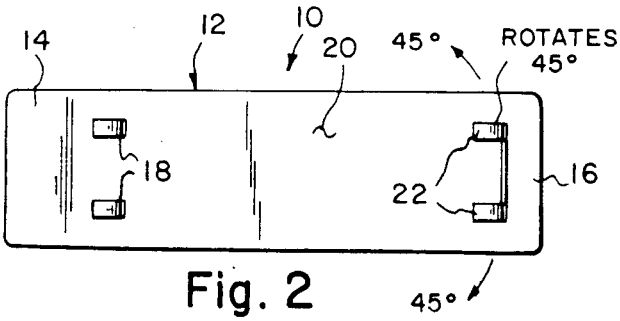
FIG. 2 is a bottom view taken in direction of arrow 2 in FIG. 1, showing that the two front casters are movable and can turn together forty five degrees in each direction.

Turning now descriptively to the drawings, in which similar reference characters denote similar elements throughout the several views, FIGS. 1 and 2 illustrate an improved skateboard 10 consisting of a deck 12 having a tail 14 and a nose 16. A pair of fixed rear wheels 18 fixed against swivelling are attached to underside 20 of the deck 12 at the tail 14. A pair of front casters 22 are attached to underside 20 of the deck 12 at the nose 16. The front casters 22 swivel together at forty five degrees in either direction for increased maneuverability of the skateboard 10.

Figure 3:
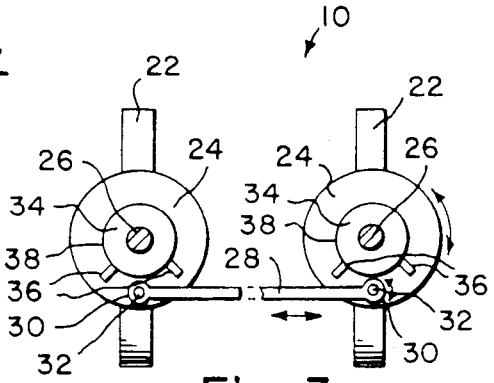
FIG. 3 is a top cross sectional view taken along in line 3—3 in FIG. 1, showing the tie bar and stop members on the two front casters in greater detail.

As best seen in FIG. 3, a pair of plates 24 are provided and are each rotatably mounted to each caster shaft 26. A tie bar 28 is pivotly mounted at each end 30 by a pivot pin 32 to each of the plates 24 so that the front casters 22 can swivel together.

A pair of fixed plates 34 being smaller in size than the rotatable plates 24 are each mounted to the underside 20 of the deck 12 on each of the caster shafts 26 above the rotatably mounted plates 24. A set of stop members 36 are mounted within each edge 38 of each of the stationary plates 34 at a forty five degree angle from each side of one pivotable end 30 of the tie bar so that the front casters 22 can swivel forty five degrees in either direction for the increased maneuverability of the skateboard 10.

Figure 4:
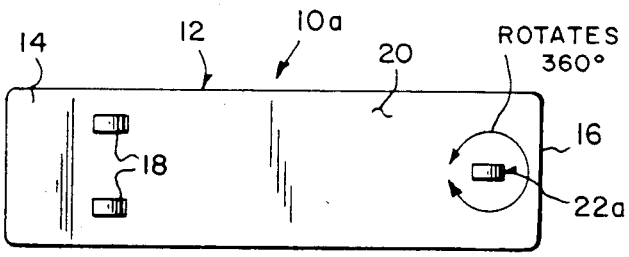
FIG. 4 is a bottom view similar to FIG. 2 of a second embodiment showing that the single front caster is movable and can rotate three hundred and sixty degrees.
Figure 5:
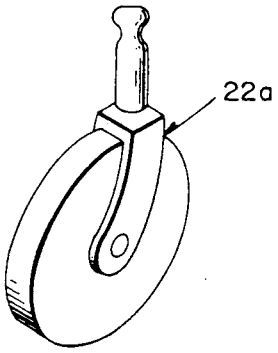
FIG. 5 is a perspective view of the front caster used in FIG. 4.

FIG. 4 shows a second embodiment of the improved skateboard **10*a* which is similar to the first embodiment 10 except that the pair of front casters 22 are replaced with a single front caster 22*a* as best seen in FIG. 5. The front caster 22*a* is attached to the underside 20 of the deck 12 at the nose 16 which can swivel three hundred and sixty degrees in either direction for increased maneuverability of the skateboard 10*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved skateboard comprising:

(a) a deck having a tail and a nose;

(b) a pair of rear wheels mounted on the underside of said deck at said tail;

(c) a pair of front casters each having an upper plate swivelly attached to a shaft on said deck;

(d) means tying said front casters together whereby said casters will swivel simultaneously;

(e) means secured to said shaft for limiting the swivel of said front casters to forty-five degrees in either direction for increased maneuverability of said skateboard.

2. An improved skateboard as recited in claim 1, whereby said trying means is a tie bar pivotly mounted at each end rotatably to each said upper plates and wherein said limiting means is a fixed plate secured concentrically to each said shaft with a pair of spaced stops adapted to engaged each said end of said tie bar at a forty-five degree angle on either side of said tie bar ends.

* * * * *